United States Patent [19]

Swanson et al.

[11] 4,030,621

[45] June 21, 1977

[54] COMPENSATING STACKER FOR MAGAZINES

[75] Inventors: Kermit E. Swanson, Naperville; Frank J. Kuzel, Chicago, both of Ill.

[73] Assignee: R. R. Donnelley & Sons Company, Chicago, Ill.

[22] Filed: Jan. 8, 1976

[21] Appl. No.: 647,366

[52] U.S. Cl. ..... 214/6.5; 93/93 DP; 214/6 DK

[51] Int. Cl.[2] ..... B65G 57/16

[58] Field of Search ..... 214/6 DK, 6 N, 6 P, 214/6.5; 53/143, 144; 93/93 R, 93 DP; 271/189, 213

[56] References Cited

UNITED STATES PATENTS

| | | | |
|---|---|---|---|
| 2,769,378 | 11/1956 | Jochem | 93/93 DP |
| 2,901,952 | 9/1959 | Taylor | 93/93 DP |
| 2,911,891 | 11/1959 | Taylor | 93/93 DP |
| 3,115,090 | 12/1963 | Elander | 214/6.5 X |
| 3,166,206 | 1/1965 | Porter et al. | 214/6.5 X |
| 3,379,320 | 4/1968 | Loach et al. | 214/6.5 |
| 3,525,443 | 8/1970 | Pomara | 214/6 DK |

*Primary Examiner*—L. J. Paperner
*Attorney, Agent, or Firm*—Wegner, Stellman, McCord, Wiles & Wood

[57] ABSTRACT

A compensating stacker for printed periodicals has lugged endless infeed means to feed periodicals forwardly seriatim in small lifts onto an upper retractable lift supporting means which opens on each cycle to drop the lifts seriatim vertically onto a lower lift supporting means which opens on each cycle to drop each lift into a stacking station. Lift rotating means turns selected lifts 180° while they are supported on the lower lift supporting means, so each stack consists of a predetermined number of lifts of which some are oriented one way and some the other. Delivery means operates intermittently to move stacks seriatim out of the stacking station.

14 Claims, 13 Drawing Figures

5'
5

| COUNT | COUNTER OUTPUT | | | |
|---|---|---|---|---|
| | Q1 | Q2 | Q4 | Q2' |
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| 5 | 1 | 0 | 1 | 0 |
| 6 | 0 | 1 | 1 | 0 |
| 7 | 1 | 1 | 1 | 0 |
| 8 | 0 | 1 | 1 | 1 |
| 9 | 1 | 1 | 1 | 1 |

| TRANSFER ELEMENT 304 | | | | |
|---|---|---|---|---|
| INPUT 306 | CONTROL TERM | | OUTPUT TERM | |
| | 308 | 310 | 312 | 314 |
| 0—1 | 0 | 0 | — | — |
| 1—0 | 0 | 0 | + | + |
| 1—0 | 1 | 0 | — | + |
| 1—0 | 0 | 1 | + | — |
| 1—0 | 1 | 1 | — | — |

+: NEGATIVE OUTPUT PULSE
—: NO OUTPUT PULSE

COMPENSATING STACKER FOR MAGAZINES

BACKGROUND OF THE INVENTION

Printed periodicals are commonly assembled into stacks of a convenient size for forming into bundles to be shipped to distributors at various destinations. The majority of periodicals are saddle stitched and thus are somewhat thicker at the bound margin than at the open edge. Thus if a stack is to be sufficiently square for shipping some of the periodicals in it must be reversed so that their bound margins are above the open edges of other magazines in the stack to compensate for the difference in thickness between the bound margin and the open edge. The problem is complicated by the fact that periodicals recently contain increasing numbers of removable coupons and return postcards which are bound into the periodical but are smaller than the page size so as to further increase the difference in thickness between the bound margin and the open edge.

There are a substantial number of patents which disclose so-called compensating stackers; and there are a number of compensating stackers on the market. Some compensating stackers, of which that disclosed in U.S. Pat. No. 3,166,206 is typical, feed batches of periodicals or folded newspapers from a shingled stream alternately into a stacking area from opposite sides, so that some of the batches have their bound or folded margins to the left of the stacking area, and others have them to the right. Another type, one of which is disclosed in U.S. Pat. No. 3,115,090, includes a support which is rotatable 180° to reverse the orientation of alternate bundles of folded sheets entering a stacking area.

Most prior art compensating stackers either have relatively complex mechanisms or require an excessive amount of space, or both; and none previously available on the market is capable of operating at modern bindery speeds of 70 to 80 trimmed lifts a minute.

SUMMARY OF THE INVENTION

The principal object of the present invention is to provide a compact, simple, and reliable compensating stacker.

Another object of the invention is to provide a compensating stacker in which the compensating mechanism is installed as a modification of a pre-existing non-compensating stacker.

Still another object of the invention is to provide a compensating stacker in which lifts of periodicals are fed seriatim onto upper lift supporting means which closes and opends in timed relationship with delivery of the lifts to it, the upper supporting means when open dropping the lifts onto a lower lift supporting means from which they are dropped into a stacking station. Selected lifts dropped onto the lower supporting means are turned 180° by rotating means which turns them while they are resting on said supporting means, so that some of the lifts are dropped into the stacking station with their bound edges aligned with the open edges of the periodicals in the other lifts.

Another object of the invention is to provide a compensating stacker which operates at current line speeds of 70 to 80 lifts per minute or at higher speeds which may be developed in the future. One of the operating features of the machine which contributes to its high speed is that the lower lift supporting means and the rotating means are separately controlled, so that they need not operate entirely sequentially. Furthermore, the machine need not reverse the orientation of alternate lifts of periodicals; but instead may run two or three lifts oriented in one way and then two or three lifts in a reversed orientation. A stack for shipping ordinarily contain 20 magazines delivered in five lifts, which means that the stack is not completely compensated because of the odd number of lifts in the stack.

Still another object of the invention is to provide a compensating stacker which has easily adjusted electronic controls to permit stacks to be formed with different ones of the lifts in the stack rotated as conditions may require.

Yet another object of the invention is to provide a compensating stacker which is readily adjusted to accommodate its operation to lifts of different heights.

THE DRAWINGS

Figure 9A:
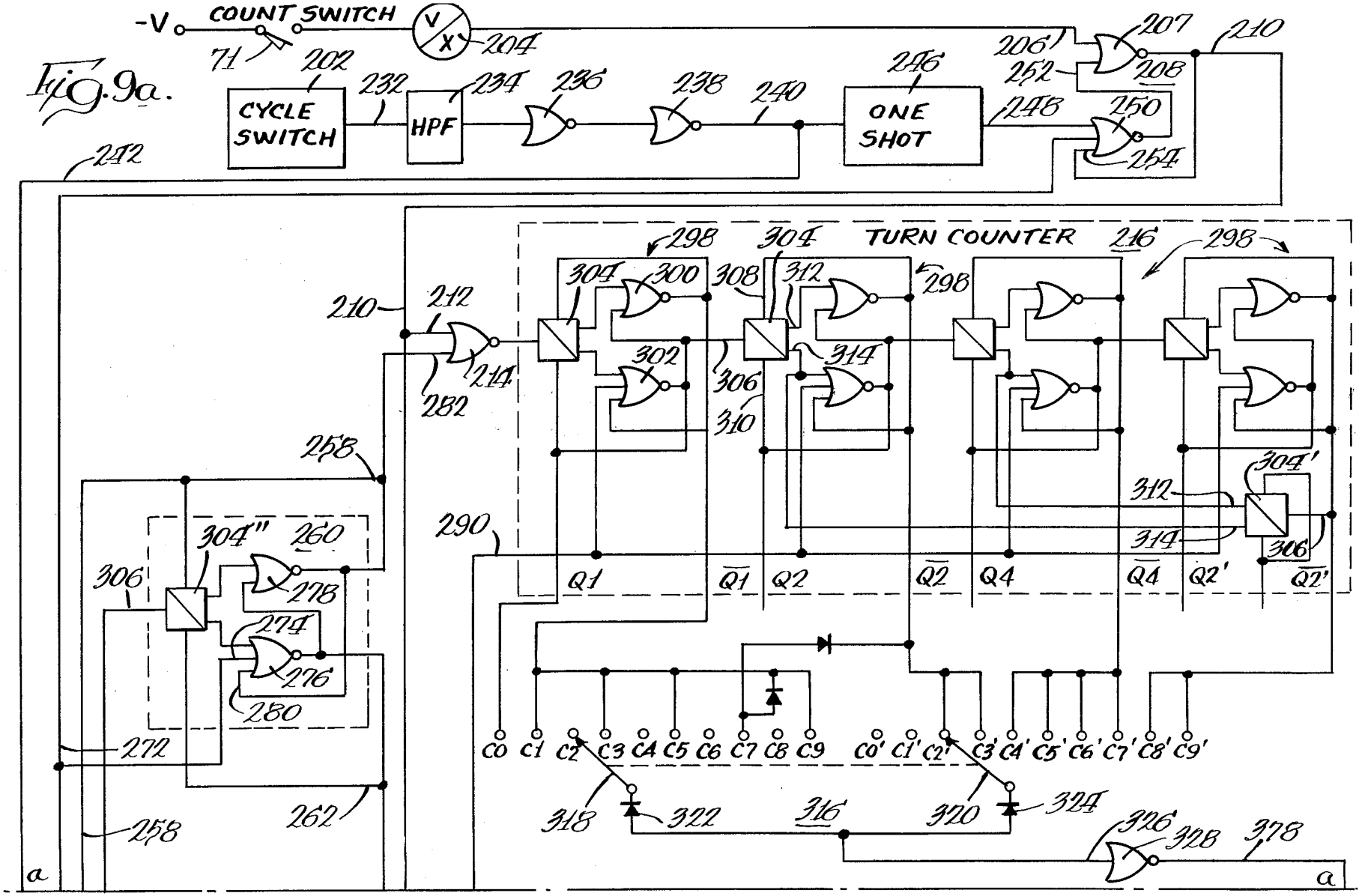
Figure 9B:
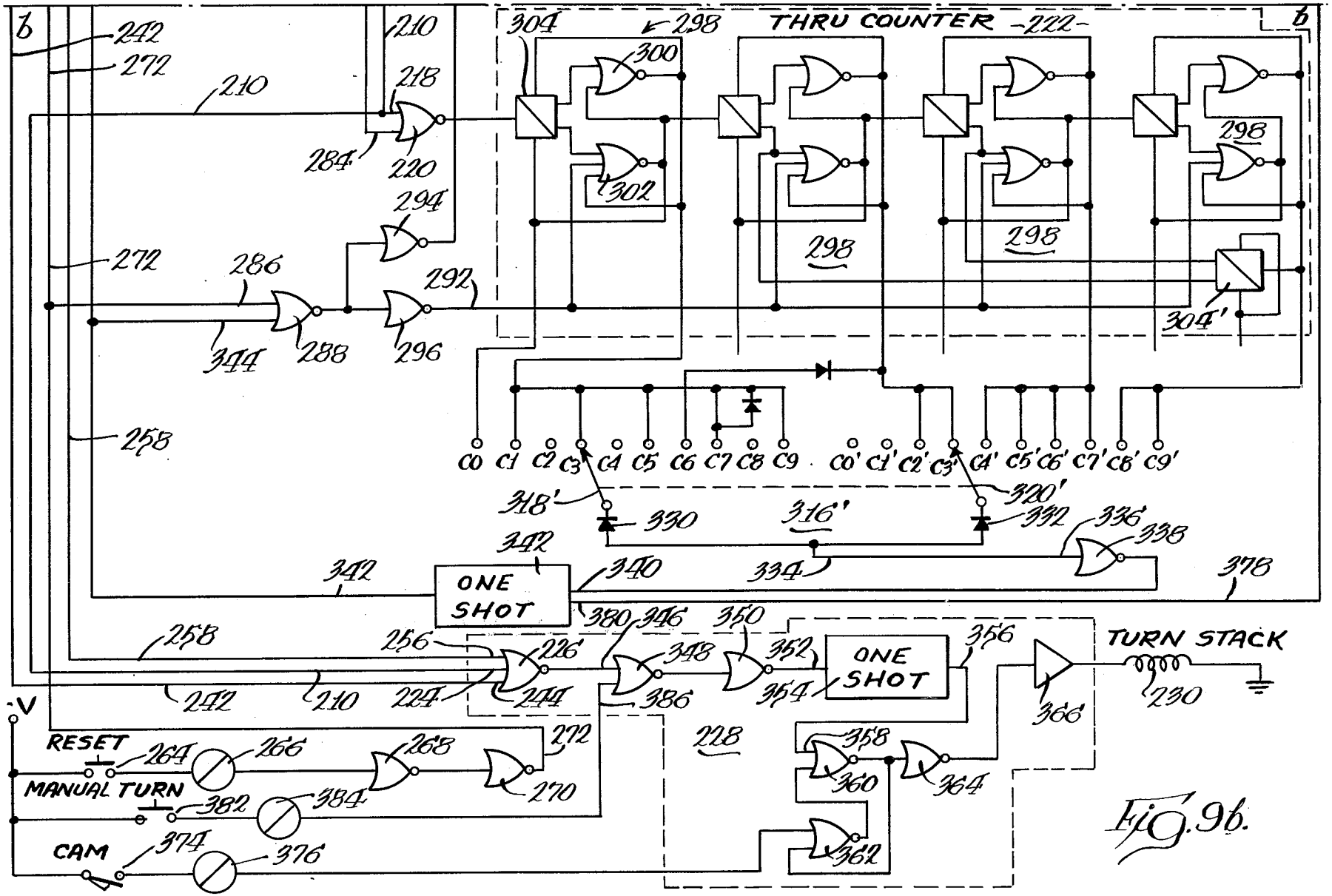

FIGS. 9*a* and 9*b* form a continuous line schematic of the principal part of the control when arranged so that partition line *a—a* of FIG. 9*a* is overlying partition line *b—b* of FIG. 9*b;*

Figures 10, 11, 12:
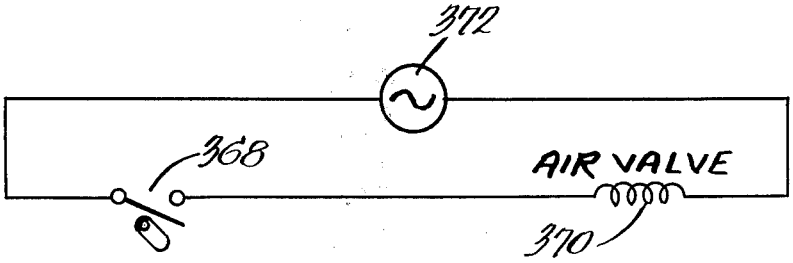

FIG. 10 is a truth table defining the operation of two counters used in the control;

FIG. 11 is a schematic of another part of the control; and

FIG. 12 is a truth table defining the operation of transfer elements which are shown in block form in FIGS. 9*a*—9*b*.

DETAILED DESCRIPTION OF THE INVENTION

The apparatus of the invention includes a machine frame, indicated generally at F; auxiliary frame means F′ for the added mechanism; infeed conveyor means, indicated generally at C; an upper lift supporting means, indicated generally at U, which is a part of a hopper, indicated generally at H; a lower lift supporting means, indicated generally at L; lift rotating means, indicated generally at R; and a stack pusher mechanism, indicated generally at P, which moves through a stacking station S which is directly below the upper and lower lift supporting means. The apparatus also includes a drive system, indicated generally at D; an in addition, the lift rotating means R includes a separate fractional revolution drive.

As previously indicated, the invention comtemplates the conversion of an uncompensated stacker to a compensated stacker. The basic stacker mechanism includes the frame F; the infeed conveyor C which is, however, inclined in this mechanism, whereas it is horizontal in the uncompensated stacker; the stacking station S; the stack pusher mechanism P; the drive mechanism D; and a control circuit for intermittently operating P. The added structure to effect the conversion of the unit to a compensating stacker includes the auxiliary frame means F'; the hopper H with its movable upper lift supporting means U; the movable lower lift supporting means L; the lift rotating means R including its separate fractional revolution drive; drive means D' by means of which the upper lift supporting means U and a modified intermittent drive for the stack pusher mechanismm P are driven from the drive means D; and an electrical circuit for controlling the operation of L and of R.

Figure 5:
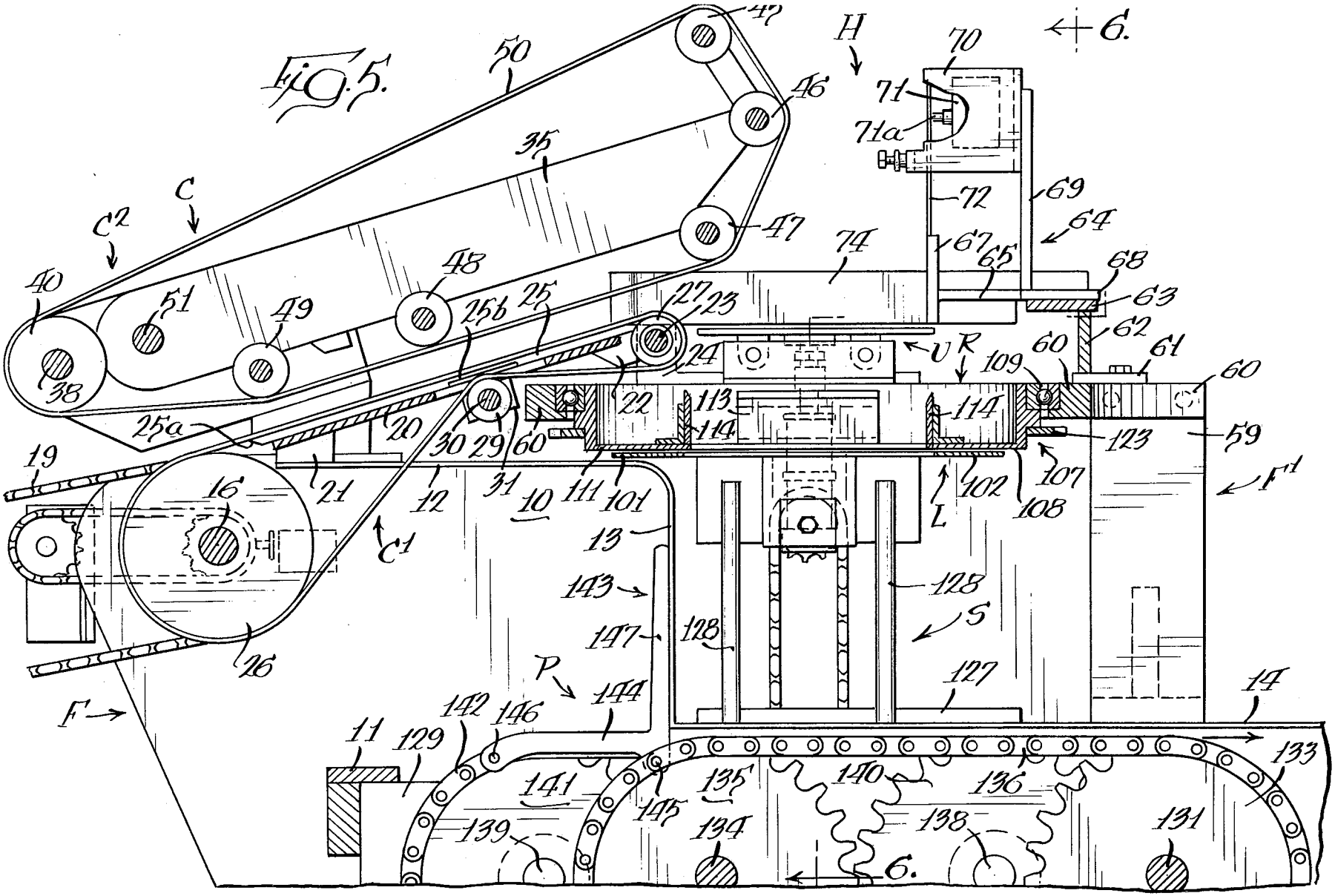
FIG. 5 is a fragmentary sectional view taken substantially as indicated along the line 5—5 of FIG. 2.
Figure 6:
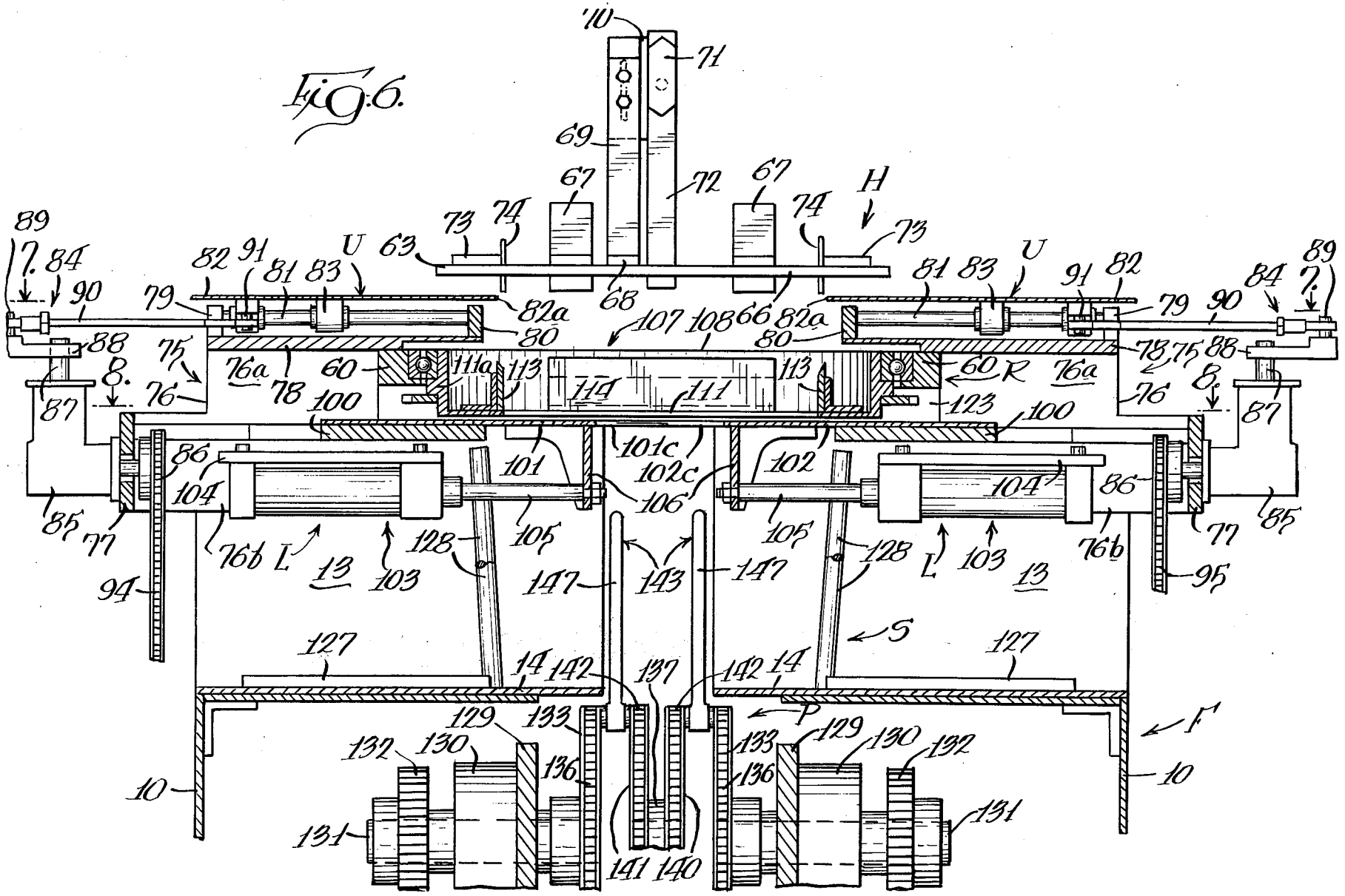
FIG. 6 is a fragmentary sectional view taken substantially as indicated along the line 6—6 of FIG. 5.

The frame F includes side plates 10 which are connected by various cross members such as the member 11 seen in FIG. 5, and the frame also includes lateral rear top plates 12 (FIG. 2), lateral upright plates 13, and lateral forward plates 14 all of which are spaced apart along the longitudinal median plane of the apparatus, as seen in FIG. 6, to accommodate portions of the stack pusher mechanism P.

Figure 1:
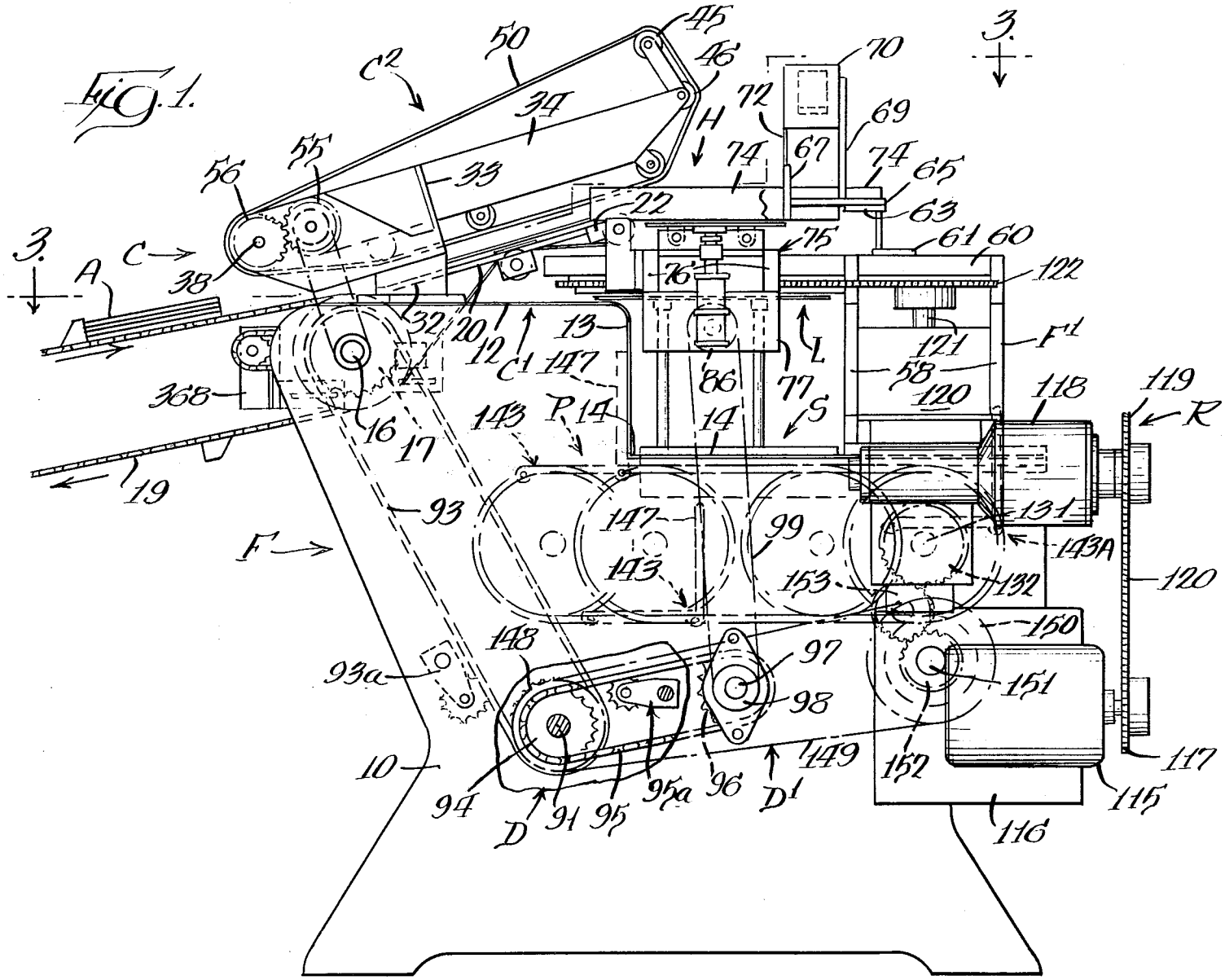
FIG. 1 is a side elevational view of a compensating stacker embodying the invention.
Figure 2:
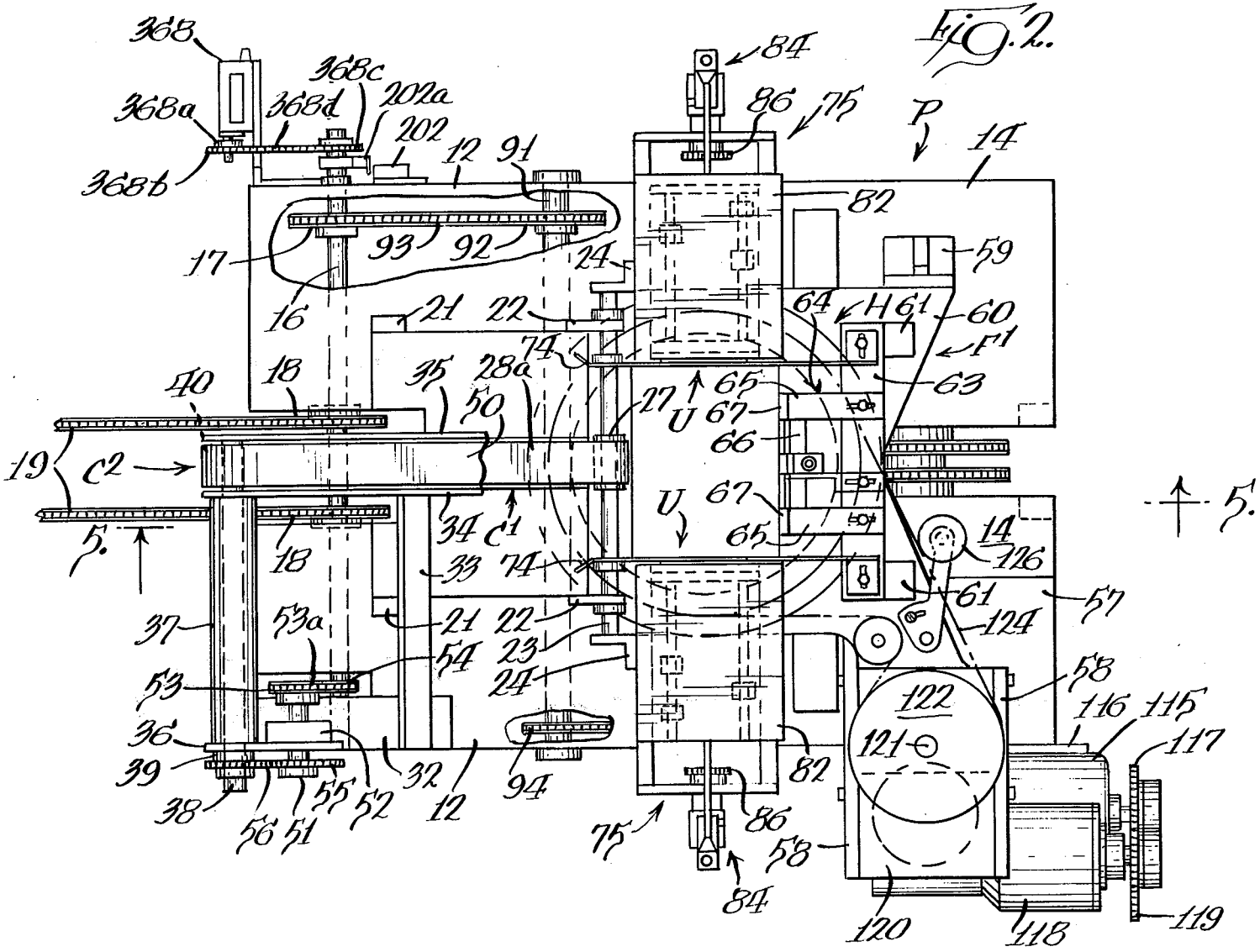
FIG. 2 is a plan view of the apparatus with parts broken away for clarity and with the lower lift support open.
Figure 4:
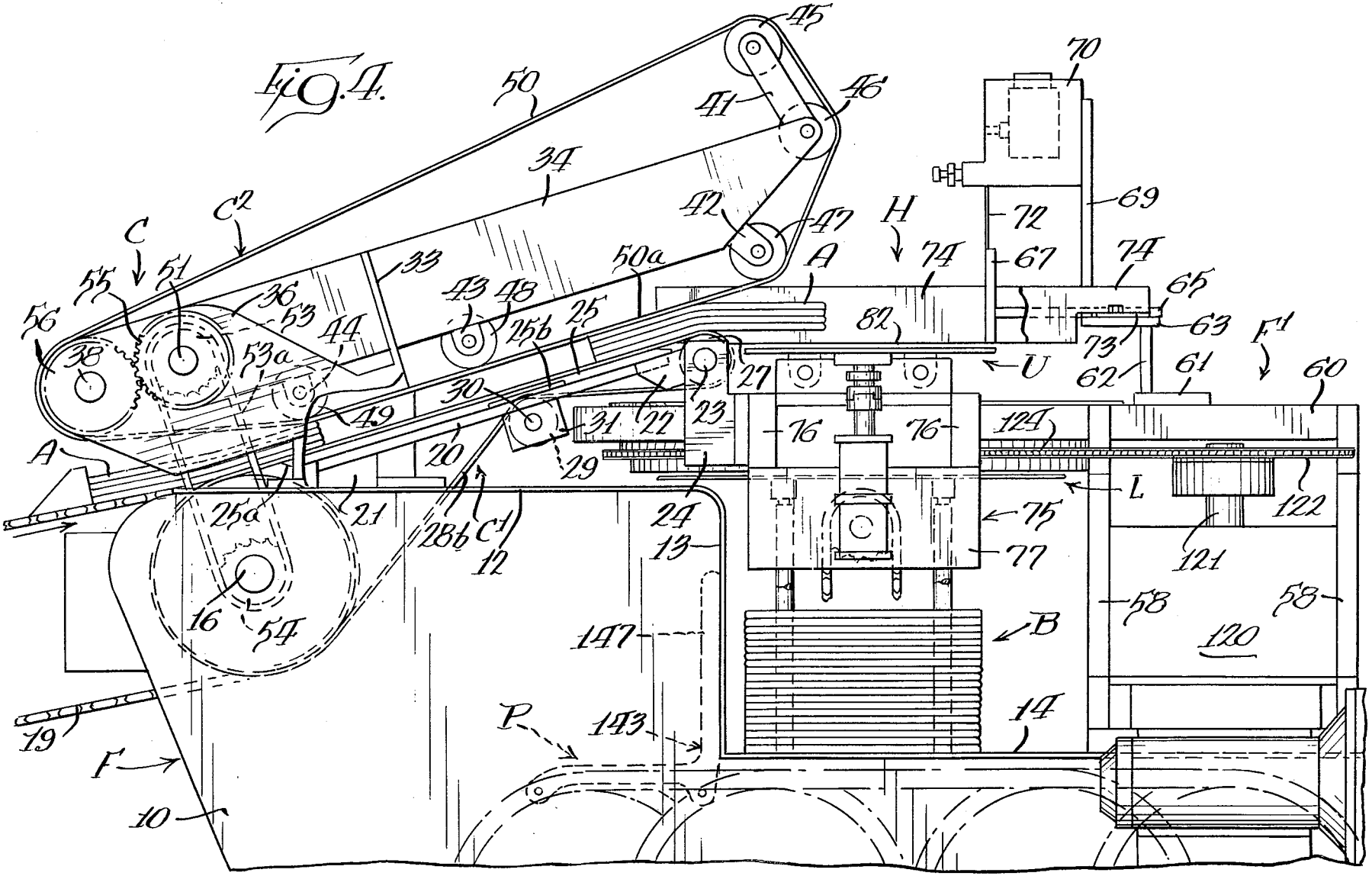
FIG. 4 is a fragmentary side elevational view showing lifts of signatures in the infeed and a completed stack in the stacking station.

Referring now particularly to FIGS. 1, 2 and 4, at the rear upper portion of machine frame F is a transverse shaft 16 near one end of which is an input sprocket 17 from which said shaft 16 is driven from the drive means D. The shaft 16 constitutes a main drive shaft for the infeed means, and it also serves to drive certain actuators which are parts of the electrical control circuit. Keyed to the shaft 16 flanking the longitudinal, median plane of the apparatus is a pair of drive sprockets 18 for lugged infeed chains 19 which feed lifts A of periodicals into the machine with their backbones leading. Typically, the lifts are picked up by the lugged chain 19 at a trimmer which trims the margins of the periodicals in lifts. The lift height is determined by the thickness of the periodicals and the trimmer cutting capacity. Periodicals are usually fed into a trimmer in lifts of four, and each periodical in the lift may be of about ¼ inch to about 7/16 inch thick; so total lift height may vary from about an inch to about 1 ¾ inches.

In addition to the lugged chains 19, the infeed conveyor means C includes lower conveyor mechanism, indicated generally at C1, and cooperating upper conveyor mechanism, indicated generally at C2. Both of the conveyor mechanisms C1 and C2 are driven from the conveyor drive shaft 16, and both of them are supported upon the frame plates 12. They cooperate to receive lifts A from the lugged chains 19 and feed them seriatim into the hopper H at a higher speed than that of the lugged chains so as to pull the lifts away from the chain lugs as the latter pass around the sprockets 18.

The lower infeed conveyor mechanism C1 includes an inclined floor 20 the lower, front end of which is supported upon brackets 21 on the rear lateral frame plates 12, and the elevated, forward end of which is supported upon brackets 22 which are carried upon a cross shaft 23 that is in turn supported upon angle members 24 which are part of the auxiliary frame means F'. A Teflon strip 25 extends longitudinally along the central area of the plate 20 and has a rearward end **25*a* which is close to the vertical plane of the shaft 16**.

The lower infeed conveyor has a drive sheave 26 keyed to the shaft 16, and an idler pulley 27 on the shaft 23; and a lower endless conveyor belt 28 is trained around the sheave 26 and the pulley 27 so it has an upper conveying run **28*a* riding on the Teflon strip 25 and a lower return run 28*b* that passes over a tension adjusting idler 29 that is journalled upon a shaft 30 which, in turn, is carried upon brackets 31 on the underside of the plate 20; and the tension adjusting idler 29 has its upper portion projecting through an opening 20*a* in the plate 20 and into a recess in the Teflon strip 25. The portion 25*b* of the Teflon strip above the opening 20*a* is thin enough that when a lift A of periodicals passes over it the pressure on the idler pulley 29 is sufficient to cause the latter to act as a sensing device by means of which lifts passing along the infeed conveyor belt upper run 28*a*** may be counted.

The upper infeed conveyor mechanism C2 is best seen in FIGS. 1, 2 and 4 to include a large bracket 32 which has an integral cross arm 33 the inner end of which carries an upper conveyor frame consisting of side plates 34 and 35 which are thus, in effect, suspended in cantilever fashion from the bracket 32. At the outer side portion of the bracker 32 is a flange that carries an upper conveyor outer side plate 36 which a sleeve 37 extends to the side plate 34. An upper conveyor input shaft 38 is journalled at 39 in the outer side plate 36 and has at its inner end a drive sheave 40. Mounted between the side plates 34 and 35 are arms 41, 42, 43 and 44 which carry upper coneyor belt pulleys 45, 46, 47, 48 and 49. An upper conveyor belt 50 is trained around the drive sheave 40 and around the pulleys 45 through 49 so that it has a lower lift engaging run **50*a* which is parallel to the conveying run 28*a* of the lower conveyor belt 28**.

The drive for the upper conveyor belt 50 is best seen in FIGS. 2 and 4 to be off the shaft 16 through an intermediate shaft 51 which is carried in a journal 52 on the outer side plate 36 of the upper conveyor C2; and an input sprocket 53 on the inner end of the shaft 52 receives a drive chain **53*a* which is also trained around a sprocket 54 on the drive shaft 16. A gear 55 on the outer end of the intermediate shaft 51 meshes with a gear 56 on the outer end of the upper conveyor input shaft 38**.

The auxiliary frame means F1, which is supported entirely upon the lateral forward frame plates 14 and one of the side plates 10, and carries all of the components which convert the stacker for compensating operation with the exception of certain of the control elements and some of the drive means D'. Further, as previously indicated, it supports the forward end of the lower infeed means through the brackets 24. The auxiliary frame F1 includes a plate 57 (FIGS. 2 and 3) which carries a pair of large, parallel upright plates 58 which cooperate with an upright bracket 59 to support a main top plate 60 upon which the hopper H including the upper lift support U, the lower lift suport L and most of the lift rotating means R are supported.

As best seen in FIGS. 1 to 5, surmounting the main top plate 60 is a pair of hopper front plates 61 to which is welded an upright cross plate 62 that is surmounted by a rearwardly extending plate 63 that serves as a support for adjustable front plate means, indicated generally at 64. Said adjustable means 64 includes a pair of mounting plates 65 which are adjustable fore and aft upon the member 63, and the rear ends of the plates 65 are connected by a cross bar 66 which carries a pair of front stops 67 against lifts A fed into the hopper H by the infeed means C abut as they are fed into the hopper.

Figure 3:
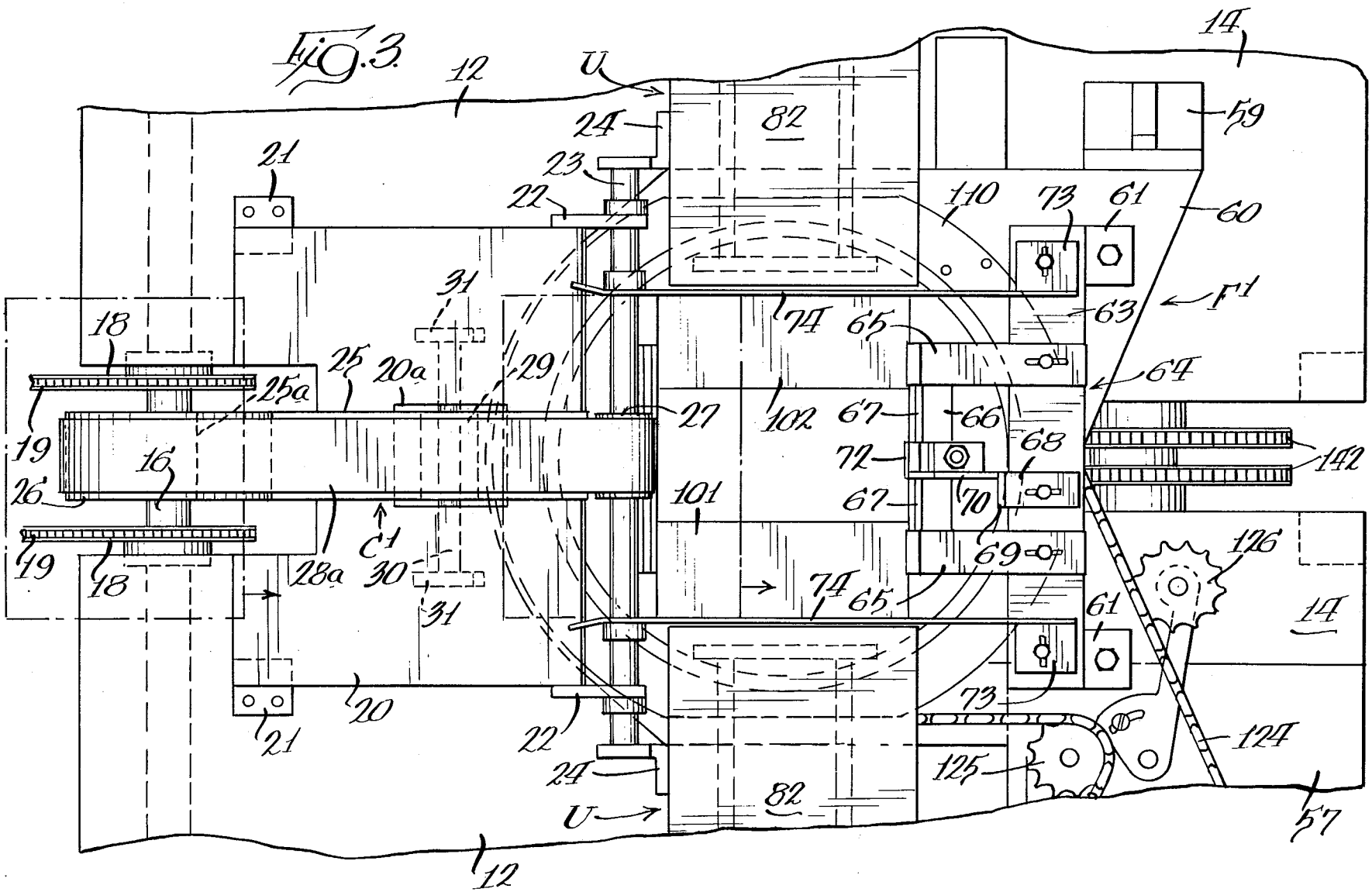
FIG. 3 is a fragmentary sectional view on an enlarged scale taken substantially as indicated along the line 3—3 of FIG. 1 and with the lower lift support closed.

As best seen in FIGS. 3 and 5, mounted upon the cross member 63 between the brackets 65 is a fore and aft adjustable plate 68 which carries an upright solenoid mounting arm 69, and projecting rearwardly from the arm 69 is a mounting member 70 for a count switch 71 that is a limit switch having a switch plunger 71*a*. A limit switch actuator 72 hangs between the front stops 67 directly in front of the infeed conveyor means C, and the lower end of the actuator 72 is in such a position that it is contacted by each lift entering the hopper so as to actuate the limit switch 71 which thus serves as a count switch.

The hopper H also includes a pair of side guide brackets 73 which are laterally adjustable upon the cross member 63, and side guides 74 extend rearwardly from the mounting bracket 73 so as to guide lifts coming off the infeed conveyor C into the center of the hopper.

Figure 7:
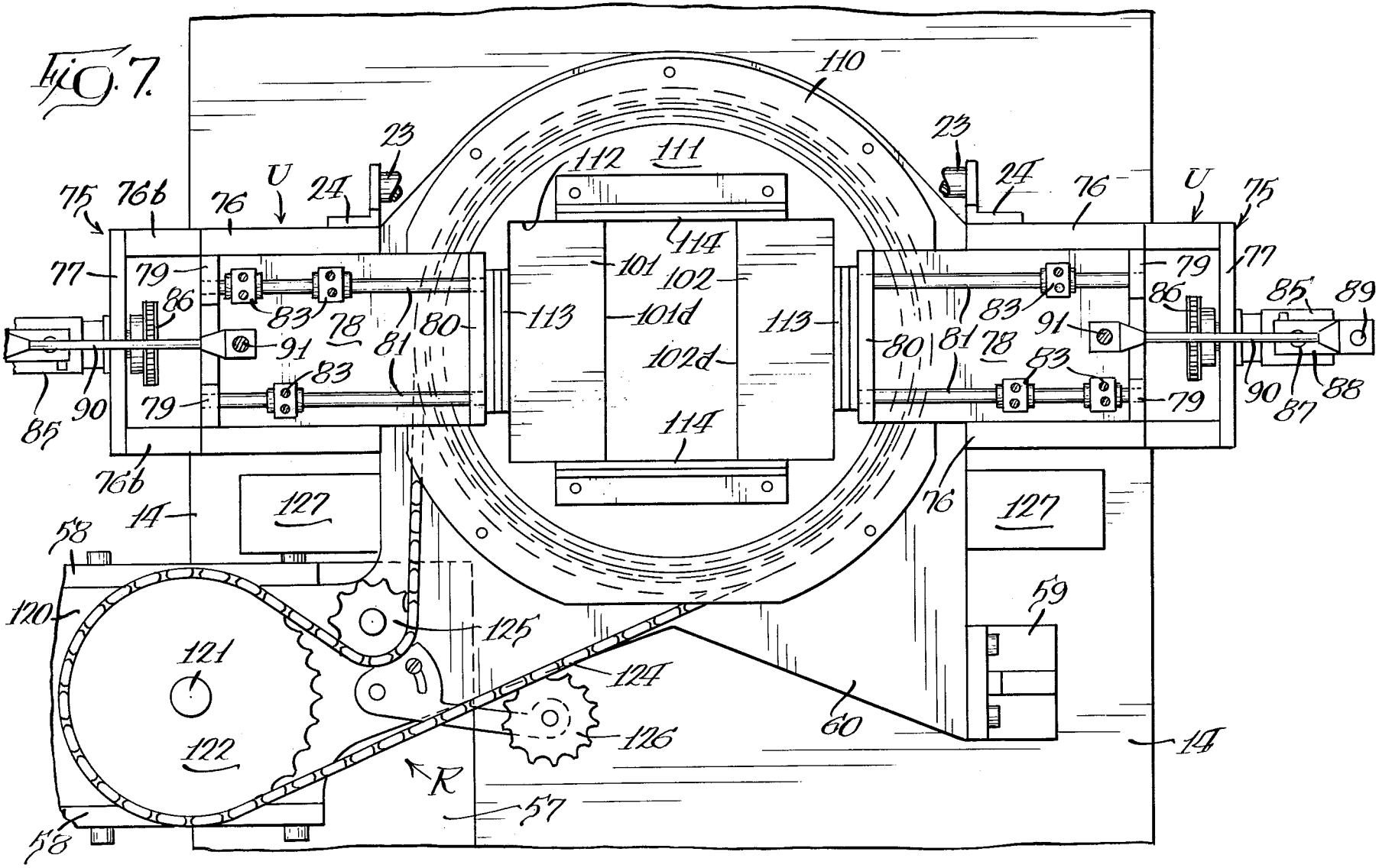
FIG. 7 is a fragmentary sectional view taken substantially as indicated along the line of 7—7 of FIG. 6 with parts omitted for clarity.
Figure 8:
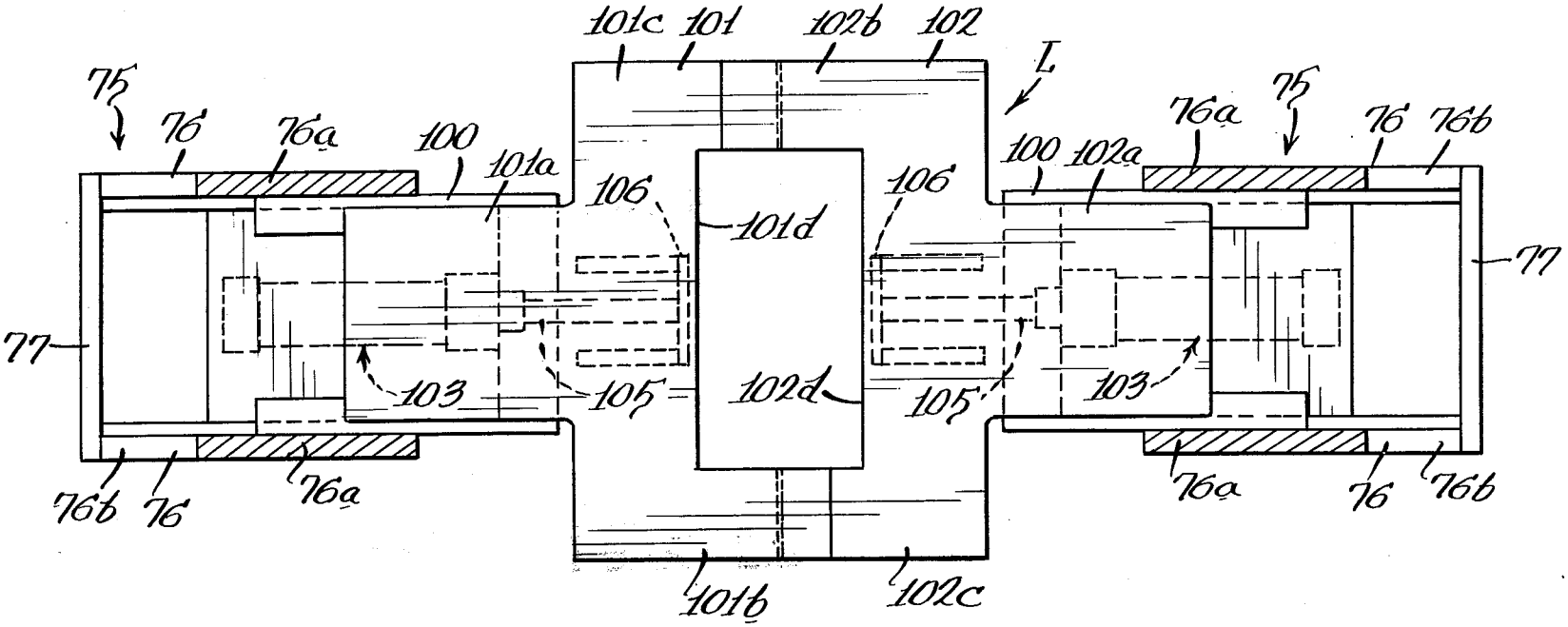
FIG. 8 is a fragmentary sectional view taken substantially as indicated along the line 8—8 of FIG. 5 with the frame and the stack pusher omitted for clarity.

Also carried upon the main upper mounting plate 60 are supporting frames, indicated generally at 75, which carry the upper lift supports U and the lower lift supports L, which extend transversely of the machine. Referring particularly to FIGS. 6 to 8, each of the box-like frames 75 is seen to comprise a pair of parallel, upright side plates 76 each of which has an upper portion 76*a* that is secured to and extends laterally from the main top plate 60, and a lower portion 76*b*; and end plates 77 connect said lower portions 76*b*. Surmounting the upper portions 76*a* of the plates 76 are upper plates 78 which are best seen in FIG. 6 to be provided with outer guide rods support 79 and inner guide rod supports 80 for parallel guide rods 81 which are a part of the mechanism for operating the upper lift supports U.

The upper lift supports per se consist of a pair of opposed, planar members 82 the under sides of which are provided with guide sleeve blocks 83 which are slidably mounted upon the guide rods 81 so that the planar members 82 may be reciprocated betweeen the retracted positions shown in the drawings and "closed" positions in which their inner edges 82*a* are close enough together that a lift is adequately supported upon the planar members although its central area is unsupported and sags somewhat between the inner edges of the planar members.

Reciprocation of the planar members 82 between the retracted position illustrated in the drawings and the above described closed position is by means of a pair of crank mechanisms, each of which is indicated at 84; and the crank mechanisms are driven from the main machine drive D by the drive means D1. Each of the crank mechanisms includes a right angle gear box 85 which is mounted upon one of the end plates 77 and has an input shaft that extends through the end plate and carries a drive sprocket 86. A gear box output shaft 87 carries a crank 88, and a pin 89 on the crank arm pivotally receives a connecting rod 90 the inner end of which makes a pivotal connection with a pin 91 which depends from a mounting block on the bottom of the planar member 82.

Referring now to the drive means D and D1, FIGS. 1 and 2 show a main drive shaft 91 which is carried in journals in the frame side plates 10 in the lower part of the machine frame. The shaft 91 carries a first sprocket 92 which is seen in FIG. 2 to be aligned with the infeed drive sprocket 17, and a chain 93 drives the infeed mechanism C from the shaft 91.

Near one end of the drive shaft 91, inside a side plate 10, is a crank mechanism drive sprocket 94 which is connected by a chain 95 to an intermediate sprocket 96 which is keyed to an intermediate shaft 97 that is journalled in bearing mountings in the frame side plates 10. The two ends of the shaft 97 extend outside the frame side plates 10 and carry sprockets 98 which are in the same vertical planes with the input sprockets 86 for the right angle gear boxes of the crank mechanisms 84; and chains 99 are trained over the sprockets 98 and the sprockets 86 to drive the crank mechanisms from the shaft 91. Chain tensioning means 95*a* for the chain 95 is carried upon one of the sidewalls 10; and chain tensioning means 93*a* for the chain 93 is carried upon other sidewall.

A single cycle of the stacker is defined as the time between the delivery of a first lift of magazines A to the hopper H and delivery of the next succeeding lift to the hopper. The drive for the crank mechanisms 84 is arranged to produce one complete revolution of the cranks 88 during each machine cycle. The timing, of course, is such that that planar members 82 are closed when a lift A drops into the hopper from the infeed belts, and are fully retracted one-half cycle later. The space between the planar members 82 when they are fully retracted is somewhat greater than the head to foot length of the largest magazine handled by the stacker, so that a lift drops between the planar members before the half cycle point, thereby giving a time for the lift to clear the planar members as the latter complete their movement to fully retracted position and start back toward closed position.

Referring now particularly to FIGS. 5, 6 and 8, the lower lift supporting means L is also carried upon the box-like frames 75 between the lower portions 76*b* of the side plates 76. A pair of transverse plates 100 mounted between the side plates 76 provide supports for confronting lower lift support plates 101 and 102 which are seen in FIGS. 6 and 8 to have respective body portions 101*a* and 102*a* and respective side flanges 101*b* and *c* and 102*b* and *c*. The side portions 101*b* and 102*b* are seen to be planar, while the side portions 101*c* and 102*c* have outer extremities which are downwardly offset so that, when the support plates 101 and 102 are in the closed position seen in FIGS. 3, 7 and 8, there are smooth, radially extending overlapping joints between the side members of the supporting plates 101 and 102. Accordingly, a lift magazines supported upon the plates may be rotated in a counterclockwise direction as viewed in FIG. 8 and the margins of the lift at both sides slide off of the overlying plate extremities 101*b* and 101*b* and onto the respective underlying plate extremities 102*c* and 101*c*. Accordingly, there is nothing upon which the lowermost magazine in a lift may catch as a lift is rotated upon the plates.

Movement of the lower lift supporting plates 101 and 102 between the closed position of FIG. 8 and an open position in which they are entirely retracted from the area below the hopper as seen in FIG. 2, is accomplished by air cylinders, indicated generally at 103, which are mounted between the lower plate portions 76*b* upon brackets 104. Each of the air cylinders 103 has a piston provided with a piston rod 105 the outer end of which is connected to a flange 106 which depends from the associated support plate 101 or 102.

When the planar members 82 of the upper support means U are in their closed positions, the space between their adjacent edges 82*a* is the same as the space between edges 101*d* and 102*d* seen in FIG. 8.

The means for controlling operation of the air cylinders 103 and operation of the lift rotating means R will be described hereinafter in the description of the electrical control circuit for the apparatus.

The lift rotating means R is best seen in FIGS. 2 and 4 and 7 to include a turntable, indicated generally at 107, that has a rotor member 108 mounted in a ball bearing raceway 109 in a central opening in the main top plate 60, and as seen in FIG. 7 the raceway is covered by a ring 110 which is omitted from FIG. 5 for clarity of illustration. As best seen in FIG. 7, the rotor 108 has a base plate 111 that has a rectangular central opening 112 through which a lift of periodicals is dropped onto the lower lift support plates 101 and 102. The four sides of the rectangular opening 112 are flanked by upstanding, shallow walls which are 113 on the short sides of the opening and 114 on the long sides. Thus, when a lift A of periodicals is on the lower lift supporting plates 101 and 102 it is flanked by the walls 113 and 114 so that rotation of the rotor 108 turns the lift upon the lower support plates 101 and 102. Rotation is counterclockwise as viewed from above, for reasons heretofore explained.

Rotation of the rotor 108 is carried out by means of a motor 115 (FIGS. 1 and 2) which is carried upon one of the frame side plates 10 by a mounting base 116. An output shaft of the motor is provided with a sprocket 117, and a half revolution drive 118 has an input sprocket 119 which is drivingly connected by a chain 120 to the sprocket 117. The drive 118 has an output portion 120 which is mounted between the parallel plates 58 of the auxiliary frame F1, and a vertical output shaft 121 carries a sprocket 122. Mounted on a sidewall 111*a* of the rotor 108 is an external, annular sprocket 123 which is in the same horizontal plane with the sprocket 122; and a drive chain 124 is wrapped around the sprockets 122 and 123 and properly positioned and tensioned by an idler sprocket 125 and an adjustable tensioning sprocket 126.

Operation of the half revolution drive 118 is described in connection with the control system. The drive actually used in the apparatus is a special paradromic index drive, available from Ferguson Machine Co.

The stacking station S is best seen in FIGS. 5 and 6 to comprise an area of the front lateral plates 14 which is directly beneath the hopper H, and on the two sides of the stacking station S are mounting plates 127 which carry sets of upstanding guide rods 128 which are seen in FIG. 6 to converge slightly toward their lower ends so that a lift of signatures dropped into the stacked station S, from the lower lift supporting means is guided between the rods 128 to a precisely predetermined position. The mounting plates 127 are adjustable laterally of the machine so as to change the space between the guide rods 128, just as the brackets 73 in the hopper are laterally adjustable to change the space between the side guides 74.

The pusher means P is seen in FIGS. 1, 5 and 6 to consist of two coordinated sets of sprockets upon which chains and pusher members move in a translatory fashion such that the pusher members always extend upwardly from the chains upon which they are mounted, so that they may push a stack of periodicals forwardly out of the stacking station S as indicated by the arrow in FIG. 5 and onto the forward extremities of the plates 14. Here they may either be removed manually, or may be picked up by a carry off conveyor which is a separate device.

As seen in FIGS. 5 and 6, a pair of parallel pusher mounting plates 129 are carried beneath the plates 14 and spaced substantially inwardly from the machine frame side plates 10. Each of the mounting plates 129 carries journals 130 for aligned drive shafts 131, and on the drive shafts 131 outboard of the journals 130 are drive gears 132. On the shafts 131 inboard of the mounting plates 129 are forward outer sprockets 133; and on aligned shafts 134 to the rear of the shafts 131 are rear outer sprockets 135; and around the sprockets 133 and 135 are trained outer pusher chains 136. A longitudinally extending central bracket 137 carries a forward internal shaft 138 and a rearward internal shaft 139 which carry respective forward inner sprockets 140 and rearward inner sprockets 141; and inner pusher chains 142 are trained around the sprockets 140 and 141.

Carried both on the outer chains 136 and on the inner chains 142 are aligned pusher members, indicated generally at at 143, each of which consists of a longitudinally extending base 144 which is pivoted at 145 on an outer chain 136 and which is pivoted at 146 on an inner chain 142. Each of the pusher members also includes an upright pusher arm 147 which is at the front of the base 144 and which projects upwardly between the forward lateral plates 14 of the frame F. In view of the tandem mounting of the pusher members 143, the upright pusher arms 147 remain upright throughout their entire paths of travel, as seen in FIG. 1.

The drive for the pusher means P is seen in FIG. 1 to also be taken off the main machine drive shaft 91 by means of a sprocket 148 and a drive chain 149 which is trained around a sprocket 150 which is keyed to a cross shaft 151. A pair of gears 152 which are in the same vertical planes with the pusher input gears 132 are selectively driven from the sprocket 150 by means of a solenoid clutch, and the gears 152 are drivingly connected to the gears 132 through intermediates gears 153. Thus, although the sprocket 150 is constantly driven when the machine is in operation, the pusher arms 147 move through the stacking station S only when the solenoid clutches are energized to mechanically link the gears 152 to the sprocket 150.

Since the pusher means P is a part of the basic stacker, it is selectively driven in conjunction with machine cycles as determined by the passage of lifts A over the infeed sensing area 25*b*. The machine may be adjusted to produce stacks consisting of different numbers of lifts, but commonly it is used to produce stacks each of which consists of five lifts. Accordingly, immediately after five consecutive lifts have been dropped into the stacking station after a stack has just been removed therefrom, the pusher means P is driven to move one set of pusher arms from the ready position illustrated in FIGS. 1, 4 and 5 to a position indicated by 143A in FIG. 1. where it has completed movement of the newly completed stack from the stacking station S to a delivery table or carry off conveyor.

The means for operating the pusher means P coordinately with the feed of lifts A into the machine is carried out as it was in original stacker, and thus is not a part of the control system which is to be described next.

which controls the closing and opening of the lower lift supporting plates 101 and 102 and the 180° rotation of the rotor 108 by the half revolution drive 118.

Referring now to FIGS. 9*a*, 9*b* and 10–12, the operation of the electronic control for the stacker will be described. Inputs to the control are provided by the count switch 71 previously identified in connection with the machine, and a cycle switch 202 (FIG. 2). The count switch is a single pole-single throw micro switch. The cycle switch 202 is a normally closed electronic proximity switch which is seen in FIG. 2 to be mounted adjacent an end of the input drive shaft 16 where it is actuated once on each cycle by a finger 202*a* on said shaft. One side of count switch 71 is connected to a negative DC voltage −V, such as −130 volts DC and the other side is connected to the input of a DC converter 204 which produces a proportionately lower voltage at its output, such as −20 volts, which is usable by the remainder of the control. Throughout the control a negative logic convention is employed in which zero volts or ground reference potential is a logic zero and a negative voltage (such as −20 volts) is a logic 1.

The output of converter 204 is connected to the reset input 206 of a latch 208, and each time count switch 71 is closed, a negative voltage or logic 1-state pulse is applied thereto. This switches latch 208 to its reset condition with a logic 0-state signal on its normal output 210. This 0-state or count pulse on output 210 is applied to the data input 212 of a NOR input gate 214 of a turn counter 216, to the data input 218 of a NOR input gate 220 of a thru counter 222 and to an enable input 224 of an input NOR gate 226 of a solenoid energization circuit 228. A 0-state pulse, when applied to input 224, enables energization circuit 228 to respond to a turn pulse derived from cycle switch 202 to energize a turn stack solenoid 230 if the control is in a turn mode of operation.

Normally closed cycle switch 202 when actuated generates a logic 0-state signal or turn pulse on its output 232. This output is applied through a high pass filter 234 to a NOR gate 236. NOR gate 236 inverts the output from a high pass filter 234 and applies it to another NOR gate 238. NOR gate 238 causes another inversion and produces a momentary 0-state turn pulse on its output 240. The turn pulse is applied through a line 242 to a data input 244 of energization circuit 228 and also applied to the input of a monostable multivibrator or one-shot 246. The one-shot 246, in response to termination of the turn pulse, generates a logic 1-state pulse on its output 248 or a duration of a few milliseconds which is applied to one input of a NOR gate 250 of latch 208. NOR gate 250, in response to this 1-state pulse, develops a 0-state signal at its output which is applied to the reset input 252 of NOR gate 207. Latch 208 is set thereby to a condition in which a 1-state signal is provided on its output 210. Latching of this condition is achieved through connection of the output 210 of NOR gate 207 to a latching input 254 of NOR gate 250. Thus, the cycle switch must be actuated after each closure of count switch before latch 208 is reset and thereby enabled to respond to a subsequent closure of count switch 71.

Energization circuit 228 is enabled to energize turn stack solenoid to execute a turn cycle in response to a turn pulse applied to input 244 of NOR gate 226 only when a logic 0-state turn enable signal is being applied to an input 256 thereof. Input 256 is connected to the output 258 of a counter control bistable multivibrator or flip-flop 260, and the logic state of the signal provided thereat is determined by the count of counters 216 and 222. Prior to commencement of operation, counter control flip-flop 260 is placed into a set condition with a logic 1-state signal at its output 258 and a logic 0-state signal at its output 262 through manual closure of a reset switch 264. One side of reset switch 264 is connected to the negative DC supply voltage −V and the other side is applied through a DC converter 266 to the input of the NOR gate 268. The output of NOR gate 268, in turn, is connected to the input of a NOR gate 270, the output 272 of which is applied to an input 274 of the reset NOR gate 276 of counter control flip-flop 260. When reset switch 264 is closed, a 1-state pulse is applied to input 274 which causes NOR gate 276 to switch its output to a 0-state if not already in that condition. The 0-state signal on the output of NOR gate 276 is applied to the latching input of a set NOR gate 278 which, in response thereto, switches its output to a 1-state. This 1-state signal is applied to a latching input 280 or NOR gate 276 to latch the flip-flop 260 so that the reset switch 264 may be released.

The 1-state signal on output 258 is applied to the enable input 282 of NOR gate which is disabled thereby from responding to count pulses. The 0-state signal on inverting output 262, on the other hand, is applied to the enable input 284 of input NOR gate 220 of thru counter 222 which is thereby enabled to respond to the count pulses.

The 1-state reset pulse on output 272 is also applied to an input 286 of a NOR gate 288 associated with reset inputs 290 and 292 of counters 216 and 222, respectively. NOR gate 288 generates a 0-state pulse on its output in response to the reset pulse. The 0-state pulse is inverted by a NOR gate 294 and applied to reset input 290 of turn counter 216 to reset it to a count of zero. The 0-state pulst is also inverted by a NOR gate 296 and applied to the reset input 292 to reset thru counter 222 to a count of zero.

Turn counter 216 and thru counter 222 are substantially identical to one another. Each has four stages 298 respectively producing normal outputs Q1, Q2, Q4 and Q2′ and inverted outputs $\overline{Q1}$, $\overline{Q2}$, $\overline{Q4}$ and $\overline{Q2'}$, respectively associated therewith. Each stage incudes a pair of NOR gates 300 and 302 and a transfer element 304. Each transfer element has an input terminal 306, two control terminals 308 and 310, and two output terminals 312 and 314, and operates in accordance with the logic truth table therefor shown in FIG. 12. The input terminal 306 of the transfer element 304 of each stage 298 is connected with the normal output of the previous stage except for the first stage in which the input terminal 306 is connected to the output of NOR gate 214 in turn counter 216 and to the ouput of input NOR gate 220 in thru counter 222. The control terminals 308 and 310 are respectively connected with the output of NOR gate 300 of the stage associated therewith and the normal output of the stage associated therewith. Output terminals 312 and 314 are respectively connected to inputs of NOR gates 300 and 302 of the stage associated therewith. The output of NOR gate 300 is connected to an input of NOR gate 302 in each stage and likewise, the output of NOR gate 302 is connected to an input of NOR gate 300. Each NOR gate 302 also has one input connected with the reset input 290 and 292 of its associted counter.

In addition to the four stages, each of counters 216 and 222 includes a fifth transfer element 304′ operating identically to transfer elements 304. Transfer element 304' has its input terminal 306 connected to the inverted output $\overline{Q2'}$ of the last stage 298, and outputs 312 and 314, respectively connected to the transfer element output terminals connected with 314 inputs of the associated NOR gates 302 of the second and third stages 298. Accordingly, both counters 216 and 222 function in accordance with the logic truth table shown in FIG. 10.

Manual selection of the numbers of lifts to be turned during each turn cycle is achieved through operation of a double-throw rotary switch 316 associated with turn counter 216. A movable contact 318 of switch 316 is connectable with ten fixed contacts respectively labeled CO–C9, and another movable contact 320 is connectable with ten other contacts respectively labeled CO'–C9'. The movable contacts 318 and 320 are connected together through diodes 322 and 324, respectively, to an input 326 of a NOR gate 328. Selected ones of the fixed contacts are appropriately connected with outputs of turn counter 216 so that a 0-state pulse is applied to input 326 in response to turn counter 216 reaching a count corresponding to the position of movable contacts 318 and 320. For example, with switch 316 in the position shown, with movable contacts 318 and 320 respectively making contact with fixed contacts C2 and C2', a 0-state signal will be generated at the output of switch 316 when turn counter 216 reaches a count of two with 1-state signals on its Q1 and Q2 outputs and 0-state signals on its Q4 and Q2' outputs.

Thru counter 222 likewise has a double-throw rotary switch 316' for selecting the number of lifts for each through cycle. Switch 316' is substantially identical to switch 316, having fixed contacts connected with the outputs of thru counter 222 identically corresponding to those of turn counter 216 and movable contacts 318' and 320' respectively connected through diodes 330 and 332 to a switch output lead 334 which, in turn, is connected to an input 336 of a NOR gate 338. Switch 316' functions to develop a 0-state pulse on its output 334 when the count of thru counter 222 reaches a count corresponding to the positional setting thereof, which is three as seen in FIG. *9b.*

With both counters reset to a count of zero and the counter control flip-flop 260 in a set condition, a count of one will be entered into thru counter 22 in response to the first actuation of the count switch 71 by the first lift of books entering the hopper H. The second lift of books will result in entry of a count of two into thru counter 222, and the third lift of books will cause entry of a count of three. With switch 316' in the position as shown, the entry of a count of three in through counter 222 results in generation of a 1-state pulse on the output of NOR gate 338 which is applied to a first input 340 of a monostable multivibrator or one-shot 342. One-shot 342, in response to this pulse, switches to its unstable state with a 1-state signal on its output 344 for a period of approximately 150 microseconds. This 1-state pulse is applied to the input terminal 306 of a transfer element 304'' of counter control flip-flop 260. Transfer element 304'' is identical to transfer element 304. Accordingly, at the end of the 1-state pulse, the transfer element 304'' applies signals to NOR gates 278 and 276 to reverse the logic states of outputs 258 and 262. Output 258 switches to a 0-state condition to enable NOR gate 214 of turn counter 216 and output 262 switches to a 1-state to disable NOR gate 220. The 1-state output from one-shot 342 is also applied to an input 344 of NOR gate 288 which results in the application of reset pulses to counter reset inputs 290 and 292 in the same fashion as if a reset pulse were applied to input 286 of NOR gate 288 in response to closure of reset switch 264. Thus, both turn counter 216 and thru counter 222 are cleared or reset to a count of zero when thru counter 222 reaches the preselected count.

With NOR gate 214 now enabled, the turn counter 216 enters a count of one in response to the next actuation of count switch 71. The 0-state signal on normal outpput 258 also enables the input NOR gate 226 of solenoid energization circuit 228. Accordingly, NOR gate 226 generates a 1-state signal on its ouput in response to the first turn pulse following the first count pulse. This signal is applied to an input 346 of a NOR gate 348 which generates a 0-state pulse in response thereto. This 0-state pulse is inverted by a NOR gate 350 to a 1-state pulse which is applied to an input 352 of a monostable multivibrator or one-shot 354.

One-shot 354, in response thereto, switches to its unstable state with a 1-state signal on its output 356 for a period of several hundred milliseconds. This 1-state pulse is applied to the set input 358 of a NOR gate 360 which is connected with another NOR gate 362 to form a latch. NOR gate 360, in response to the 1-state pulse from one-shot 354, switches to, and is latched into, a condition with a 0-state signal on its output. This signal is inverted by a NOR gate 364 to energize turn stack solenoid 230.

When the turn stack solenoid is energized, a stop arm in the half revolution drive 118–120 is moved out of blocking engagement with a mating member on the output of the clutch in said drive. Once moved out of blocking engagement, the stop arm may be moved back into the path of blocking engagement so that the clutch is again disengaged to terminate drive power to the rotor 108 after 180° of rotation. Return of the stop arm is achieved through closure of a switch 374, which is operated by a cam that is part of the half revolution drive 118–120. The switch 374 is closed only after the turn stack solenoid has been energized sufficiently long to ensure that deenergization thereof and the resulting return of the stop arm will not result in termination of rotary drive until 180° of revolution has been achieved.

When switch 374 is closed, negative power supply voltage −V is applied to the input of a DC converter 376 which, in response thereto, applies a 1-state pulse to an input of NOR gate 362. This results in development of a 0-state signal on the output of NOR gate 362 which is applied to the input of NOR gate 360. At the end of the one-shot period, the signal applied to input 358 of NOR gate 360 is also in a 0-state condition which results in a 1-state signal being developed on its output and deenergization of the turn stack solenoid 230 through the action of NOR gate 364 and amplifier 366.

Upon occurrance of the next actuation of count switch 71, the turn counter 216 is advanced to a count of two; the cycle switch 202 again results in energization of turn stack solenoid 230 and the above-described sequence of operation is repeated. Each successive lift of books is rotated 180° in the above-described fashion until the count of turn counter 216 selected by switch 316 has been reached. With switch 316 in the position as shown, a 1-state pulse is generated on the output of NOR gate 328 when a count of two is reached by turn counter 216. This pulse is applied through a lead 378 to another input 380 of one-shot 342 which switches to its uns able 1-state in response thereto. The transition of the one-shot output back to a 0-state at the end of the one-shot period is applied to the input terminal 306 of the transfer element 304''. This causes flip-flop 360 to switch to enable thru counter input NOR gate 220 and disable turn counter input NOR gate 214 and results in the clearing of both counter 216 and counter 222. However, prior to such disablement, a turn pulse is applied to the input 244 of the energization input NOR gate 226 to effect a rotation of the second lift. After this lift is turned, the thru counter 222 commences counting and operation continues in the above-described fashion with three lifts not being turned followed by two lifts being turned, and so on. If there are more than five lifts to a stack, the counters are adjusted accordingly so that one-half of the lifts in a stack are turned, or one-half minus one for stacks having an odd number of lifts.

In addition to automatic energization of turn stack solenoid 230, the turn stack solenoid may be energized through manual actuation of a turn switch 382. Closure of manual turn switch 382 results in the application of the negative supply voltage −V to a converter 384. Converter 384, in response thereto, applies a 1-state signal to an input 386 of NOR gate 348. The turn solenoid energization circuit 228 responds to this 1-state signal applied to input 286 in the same fashion as if a 1-state signal were automatically applied to the input 346 of NOR gate 348.

Operation of the air cylinders 103 for the lower stack support plates 101 and 102 is controlled by a normally open cam operated switch 368 (FIGS. 1 and 2) which is mounted on a bracket adjacent one end of the infeed drive shaft 16. The switch 368 has a cam shaft **368*a* which is provided with a sprocket 368*b* so that it may be driven from a sprocket 368*c* on the shaft 16 by a drive chain 368*d* so as to make one revolution per machine cycle. The cam switch is available from Candy Mfg. Co., and has adjustable cam lobes to vary both the point in a machine cycle when the switch 368** is closed, and the length of time that it remains closed.

Closing the switch 368 energizes a solenoid 370 of a solenoid valve which controls operation of the lower lift support air cylinders 103; and the lower lift support plates 101 and 102 are thus reciprocated once in each machine cycle. Timing of the switch 368 is such that the support plates 101 and 102 are closed just before a lift is dropped by the upper support planar members 82; and said support plates are started to retracted position shortly after turn stack solenoid 230 is energized in the turn mode to turn the rotor 108, and before the 180° rotation is completed.

While the details of the composite circuitry of the various circuit logic elements of the control, such as the NOR gates, transfer elements and counters, form no part of the invention, and various conventional designs are available for such elements, a control was constructed in accordance with the schematic of FIGS. **9*a* and 9*b* and the schematic of FIG. 11,** using the below-identified devices, which operates satisfactorily.

| Ref. No. | Description | Designation | Manufacturer |
|---|---|---|---|
| 207, 214, 220, etc. | All NOR gates except those of counters 216, 222 | Norpak Transfer Memory Pack Class 8852, Type L-11 | Square D Company |
| 246, 342, 354 | One shot | Norpak Single Shot Pack Class 8852 Type L-16 | " " |
| 216, 222 | Counter | Norpak O-9 Decade Counter Class 8852 Type L-12 | " " |
| 316, 316' | Switch | Rotary Selector Switch Class 8851 Type T-10 | " " |
| 304', 304'' | Transfer Element | Norpak Transfer Memory Pack Class 8852, Type L-11 | " " |

Reference may be had to "Logic Fundamentals" published by the Square D Company for further information concerning the above-indicated elements.

We claim:

1. In a stacker for printed periodicals which includes a frame, drive means on the frame for driving the stacker through successive machine cycles, driven infeed means to feed a small lift of printed periodicals forwardly into the stacker on each machine cycle, a stacking station forward of and below said infeed means to receive said lifts seriatim on top of one another, and delivery means which is operable intermittently to move stacks consisting of predetermined numbers of successive lifts seriatim out of said stacking station, an improvement consisting of apparatus for reversing the orientation of certain of said lifts so the stacks are effectively compensated, said apparatus comprising, in combination:

upper substantially horizontal lift supporting means which is positioned directly above the stacking station to receive successive lifts of periodicals from the infeed means, said upper lift supporting means being movable;

first drive means for moving said upper lift supporting means in timed relationship with the infeed means to drop each lift vertically a predetermined period of time after it is received;

lower substantially horizontal lift supporting means positioned between the upper lift supporting means and the stacking station, said lower lift supporting means being movable between a closed position and an open position;

second drive means for moving said lower lift supporting means between said positions;

lower lift support control means for actuating said second drive means in timed relationship with the infeed means to close said lower lift supporting means for receiving a lift from the first lift supporting means and to thereafter open said lower lift supporting means;

a turntable operatively associated with but independent of said lower lift supporting means to rotate lifts supported on said lower lift supporting means;

turntable drive means for rotating said turntable in 180° increments;

and turntable drive control means for operating said turntable drive means only when certain predetermined lifts in each of said predetermined number of successive lifts are on said lower lift supporting means, whereby only said certain lifts are rotated and each stack contains some lifts in a first orientation and some lifts which are turned 180° from said first orientation.

2. The combination of claim 1 in which the lower lift supporting means comprises two effectively coplanar confronting plates, each of said plates having an edge which overlies a marginal portion of the other of said plates, and said edges extending generally radially in opposite directions from the axis of rotation of a lift supported on said plates, and in which the lift rotating means turns a lift in a direction so that the leading margin of the lift during rotation slides off the overlying edges onto the underlying plates.

3. The combination of claim 2 in which the second drive means reciprocates the plates simultaneously toward and away from each other.

4. The combination of claim 1 in which the upper lift supporting means comprises two opposed planar members which are effectively coplanar and which are reciprocable toward and away from each other.

5. The combination of claim 4 in which the first drive means comprises separate cranks operatively connected to said planar members and constantly driven by the stacker drive means to make one revolution each time a lift is fed onto said planar members and thus cycle the planar members between adjacent and remote limit positions, the eccentricity of said cranks being sufficient to permit a lift to drop clear of the planar members as the latter approach and begin to return from their remote limit positions.

6. The combination of claim 1 in which the lower lift supporting means comprises two opposed plates which are effectively coplanar, and in which the second drive means reciprocates said plates simultaneously toward and away from each other.

7. The combination of claim 6 in which the second drive means comprises a pair of fluid cylinders, one operatively connected to each plate, and in which the lower lift support control means includes a solenoid operated normally closed valve controlling the admission of fluid to said cylinders, and an electrical cam switch driven in timed relationship with the infeed means for controlling the time and duration of energization of said solenoid.

8. The combination of claim 7 in which the lower lift supporting means is independent of the turntable, and the latter rotates a lift on the surface of said lower lift supporting means.

9. The combination of claim 8 in which the lower lift supporting means comprises two effectively coplanar confronting plates, each of said plates having an edge which overlies a marginal portion of the other of said plates, and said edges extending generally radially in opposite directions from the axis of rotation of a lift supported on said plates, and in which the lift rotating means turns a lift in a direction so that the leading margin of the lift during rotation slides off the overlying edges onto the underlying plates.

10. The combination of claim 8 in which the turntable comprises a rotatably mounted disc overlying the opposed plates of the lower lift supporting means, said disc having a central opening with two parallel sides provided with upstanding webs, and said opening being large enough to receive a lift with said webs in very close spaced relationship to two sides of the lift.

11. The combination of claim 10 in which the turntable drive means comprises an electric motor, and power transmission means between said motor and said disc.

12. The combination of claim 1 in which the turntable comprises a rotatably mounted disc overlying the lower lift supporting means, said disc having a central opening with two parallel sides provided with upstanding webs, and said opening being large enough to receive a lift with said webs in very close spaced relationship with two sides of the web.

13. The combination of claim 1 in which the second drive means comprises a pair of fluid cylinders, one operatively connected to each plate, and in which the lower lift support control means includes a solenoid operated normally closed valve controlling the admission of fluid to said cylinders, and an electrical cam switch driven in timed relationship with the infeed means for controlling the time and duration of the energization of said solenoid.

14. The combination of claim 1 in which the turntable drive control means includes an electrical switch, actuating means driven in timed relationship with the infeed means for actuating said switch once on each machine cycle, and electrical counter means operatively associated with said electrical switch so that actuation of the electrical switch energizes the turntable drive means only on certain selected machine cycles.

* * * * *